US009470088B2

(12) United States Patent
Ahola

(10) Patent No.: US 9,470,088 B2
(45) Date of Patent: Oct. 18, 2016

(54) ROCK ANCHOR BOLT

(71) Applicant: SUOMEN METALLITYO OY, Pori (FI)

(72) Inventor: Tomi Ahola, Pori (FI)

(73) Assignee: Suomen Metallityö Oy, Pori (FI)

( * ) Notice: Subject to any disclaimer, the term of this patent is extended or adjusted under 35 U.S.C. 154(b) by 0 days.

(21) Appl. No.: 14/650,704

(22) PCT Filed: Dec. 4, 2013

(86) PCT No.: PCT/FI2013/051136
§ 371 (c)(1),
(2) Date: Jun. 9, 2015

(87) PCT Pub. No.: WO2014/091074
PCT Pub. Date: Jun. 19, 2014

(65) Prior Publication Data

US 2015/0322785 A1 Nov. 12, 2015

(30) Foreign Application Priority Data

Dec. 10, 2012 (FI) ..... 20126282

(51) Int. Cl.
*E21D 20/02* (2006.01)
*E21D 21/00* (2006.01)

(52) U.S. Cl.
CPC ..... *E21D 20/02* (2013.01); *E21D 20/028* (2013.01); *E21D 21/008* (2013.01); *E21D 21/0033* (2013.01); *E21D 21/0093* (2013.01)

(58) Field of Classification Search
CPC ... E21D 20/02; E21D 20/021; E21D 20/025; E21D 20/028
USPC ..... 405/259.5
See application file for complete search history.

(56) References Cited

U.S. PATENT DOCUMENTS 4,369,003 A * 1/1983 Brandstetter ..... E21D 21/008 405/259.3
4,461,600 A * 7/1984 Norkus ..... E21D 9/001 405/259.5

(Continued)

FOREIGN PATENT DOCUMENTS

CN 1258335 A 6/2000
CN 102146673 A 8/2011

(Continued)

OTHER PUBLICATIONS

International Search Report (PCT/ISA/210) mailed on Apr. 8, 2014, by the Finnish Patent Office as the International Searching Authority for International Application No. PCT/FI2013/051136.

(Continued)

*Primary Examiner* — Frederick L Lagman
(74) *Attorney, Agent, or Firm* — Buchanan, Ingersoll & Rooney PC

(57) ABSTRACT

In a rock anchor bolt a centering member includes an outlet hole for removing any leakage water flowing into a borehole. The rock anchor bolt includes a sealing device provided around the outer end of a tube to seal the borehole watertight as a tightening nut is being tightened, and an outlet tube provided in a casting space between the tube and a drawbar to carry out the leakage water as grouting paste is being injected, the inner end of which outlet tube extends to the vicinity of an expansion member and the outer end of the outlet tube extends out from the outlet hole of the centering member. The tube has one or more first casting holes at the outer end of the tube in the vicinity of the sealing device and one or more second casting holes at the inner end of the tube near the expansion member.

4 Claims, 4 Drawing Sheets

Fig. 1

(56) References Cited

U.S. PATENT DOCUMENTS

Figure 1:
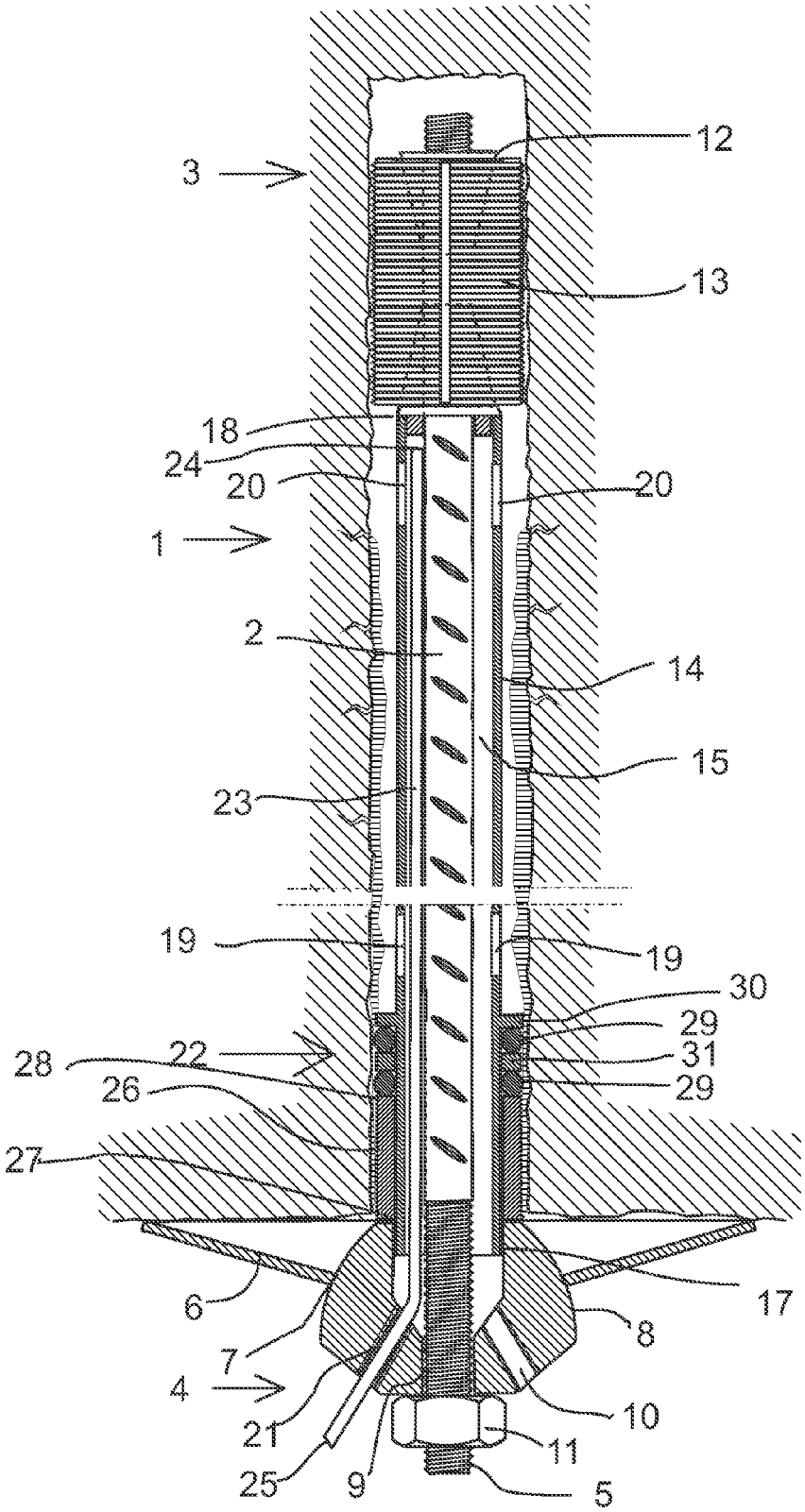

| | | | | |
|---|---|---|---|---|
| 5,003,749 | A * | 4/1991 | Harke | E04G 23/0203 52/703 |
| 5,636,945 | A * | 6/1997 | Nes | E21D 21/0086 405/259.1 |
| 7,381,013 | B1 | 6/2008 | Rataj et al. | |
| 8,678,729 | B2 * | 3/2014 | Salgado | F16B 13/066 405/259.5 |
| 8,714,883 | B2 * | 5/2014 | Rataj | E21D 21/008 405/259.3 |
| 8,998,541 | B2 * | 4/2015 | Ahola | E21D 20/02 405/259.1 |
| 2012/0177448 | A1 | 7/2012 | Steyn et al. | |
| 2014/0037388 | A1 | 2/2014 | Ahola | |

FOREIGN PATENT DOCUMENTS

| | | | | |
|---|---|---|---|---|
| DE | 2749068 | A1 * | 5/1979 | E21D 20/02 |
| DE | 8903238 | U1 | 8/1989 | |
| FI | U9687 | | 4/2012 | |
| FI | 124908 | B | 3/2015 | |
| GB | 1025728 | A | 4/1966 | |
| JP | 2009-84860 | A | 4/2009 | |
| SU | 909198 | A1 | 2/1982 | |
| WO | 98/45576 | A1 | 10/1998 | |
| WO | WO 2012/113976 | A1 | 8/2012 | |

OTHER PUBLICATIONS

Finnish Search Report issued Nov. 6, 2013 for Finnish Application No. 20126282.

Office Action issued on Jun. 3, 2016, by the State Intellectual Property Office of the People's Republic of China in corresponding Chinese Patent Application No. 201380069441.0 (7 pages).

* cited by examiner

ROCK ANCHOR BOLT

FIELD OF THE INVENTION

The invention relates to a rock anchor bolt as defined in the preamble of claim 1.

BACKGROUND OF THE INVENTION

A rock anchor bolt is a long rock bolt which is used to reinforce rock cuts, cavities and walls of tunnels. A variety of structures can also be suspended from a rock anchor bolt installed in its place. Typically, when reinforcing a rock, rock anchors are used as an array of several rock anchors installed at a distance from one another. Rock anchors function by binding the rock mass which is present in the vicinity of the surface of the rock and which may include cracks and boulders to the firmer and more solid internal part of the rock, this way preventing rockfall.

Typically, the rock anchor bolt is a so-called expansion-shell bolt having a drawbar which is made of reinforcing steel and which has a mechanical expansion-shell member at the end thereof. The expansion of the expansion-shell member is provided by a tightening nut which is disposed at the end of the drawbar extending out from the borehole and during the tightening of which the draw member will move and draw a wedge or the like to the inside of the expansion shell. Installation of the expansion-shell bolt is effected by boring a long dead hole for each bolt in the wall of the rock to be reinforced. The expansion-shell anchor bolt is inserted into the dead hole up to a desired depth. Then, the expansion-shell anchor bolt is secured in its position by expanding the expansion member at the inner end, i.e. the point, thereof so as to press the expansion member against the wall of the borehole. Finally, grouting paste such as cement or resin is injected around the anchor bolt in the bore-hole so as to grout the anchor bolt. If grouted, it becomes more firm a reinforcement.

The closest prior art is disclosed in patent application FI 20115182 and utility model FI-U9687.

Advantages of an expansion-shell bolt include immediate readiness right after installation, good corrosion resistance when grouted and easy installation. Without grouting, the bolt is easily subjected to corrosion. Grouting can also ensure functioning of the bolt if the anchorage at the end of the hole should fail.

Water leaking into the borehole from fine cracks of the rock significantly hinders the installation of the anchor bolt and the injection of the grouting paste. The water may pour out from the borehole as a continuous stream. The problem is that grouting paste is washed away with the water. In addition, the water may remain as pockets in the borehole and within the grouting paste, weakening the reinforcement and causing corrosion. Therefore, leaking boreholes may not be grouted according to regulations.

OBJECTIVE OF THE INVENTION

The objective of the invention is to remedy the above-mentioned defects.

In particular, the objective of the invention is to disclose a rock anchor bolt enabling injection of grouting paste into a borehole which is leaking water.

SUMMARY OF THE INVENTION

The rock anchor bolt according to the invention is characterized by what is presented in claim 1.

In this disclosure, the term "inner" refers to a part which is deeper inside the rock in the borehole than another part referred to by the term "outer".

The rock anchor bolt according to the invention includes

- a drawbar with an inner end to be inserted into the borehole and an outer end extending out from the borehole and having an external thread,
- a support plate for supporting the outer end of the rock anchor bolt against the surface of the rock around the mouth of the borehole, the support plate having a center hole,
- a centering member which is provided at the outer end of the drawbar in the center hole of the support plate and which centering element includes a central hole through which the outer end of the drawbar is adapted to extend and an injection hole through which grouting paste is injectable,
- a tightening nut turned on the external thread of the outer end of the drawbar against the centering element in order to draw the drawbar outward relative to the borehole for tightening the anchor bolt in its place,
- a conical member connected substantially immovably to the drawbar in the vicinity of the inner end of the drawbar,
- an expansion member inside which the conical member is provided, the expansion member being adapted to expand as the drawbar is being drawn outward by means of the tightening nut and as the conical member is at the, same time moving relative to the expansion member in order to expand the expansion member and make it adhere to the wall of the borehole,
- a tube made of a rigid material and fitted around the drawbar so that a casting space is provided between the tube and the drawbar for receiving and carrying grouting paste injected through the injection hole of the centering member, the tube including an outer end which is supported on the centering member, an inner end and casting holes for allowing the injected grouting paste to flow between the space between the tube and the wall of the borehole and the casting space.

According to the invention, the centering member includes an outlet hole for removing any leakage water flowing into the borehole. The rock anchor bolt includes a sealing device which is provided around the outer end of the tube for sealing the borehole water-tight as the tightening nut is being tightened. An outlet tube is provided in the casting space between the tube and the drawbar for carrying the leakage water out as grouting paste is being injected. The inner end of the outlet tube extends to the vicinity of the expansion member and the outer end of the outlet tube extends out through the outlet hole of the centering member. The tube has one or more first casting holes at the outer end of the tube in the vicinity of the sealing device and one or more second casting holes at the inner end of the tube in the vicinity of the expansion member. This way, as grouting paste is being injected it fills the casting space between the tube and the drawbar as well as the space between the borehole and the tube from the outer end toward the inner end so as to force any leakage water ahead of the grouting paste to the inner end of the outlet tube and further out along the outlet tube.

In one embodiment of the rock anchor bolt, the sealing device includes a pressure sleeve provided with play around the tube so that it moves axially in the direction of the tube, and the pressure sleeve has a first end which is disposed against the centering member and a second end. Further, the sealing device includes a seal ring which is made of a flexible material formable under pressure, such as rubber, and provided against the pressure sleeve. In addition, the sealing device includes an abutment member which is fixed relative to the tube and located on the opposite site of the seal ring relative to the pressure sleeve. As the tightening nut is being turned, the pressure sleeve presses the seal ring against the abutment member and the seal ring expands under pressure and becomes sealed against the wall of the borehole.

In one embodiment of the rock anchor bolt, the sealing device includes two or more seal rings provided between the pressure sleeve and the abutment member with an intermediate sleeve provided between each two adjacent seal rings with play around the tube.

LIST OF FIGURES

Figure 2:
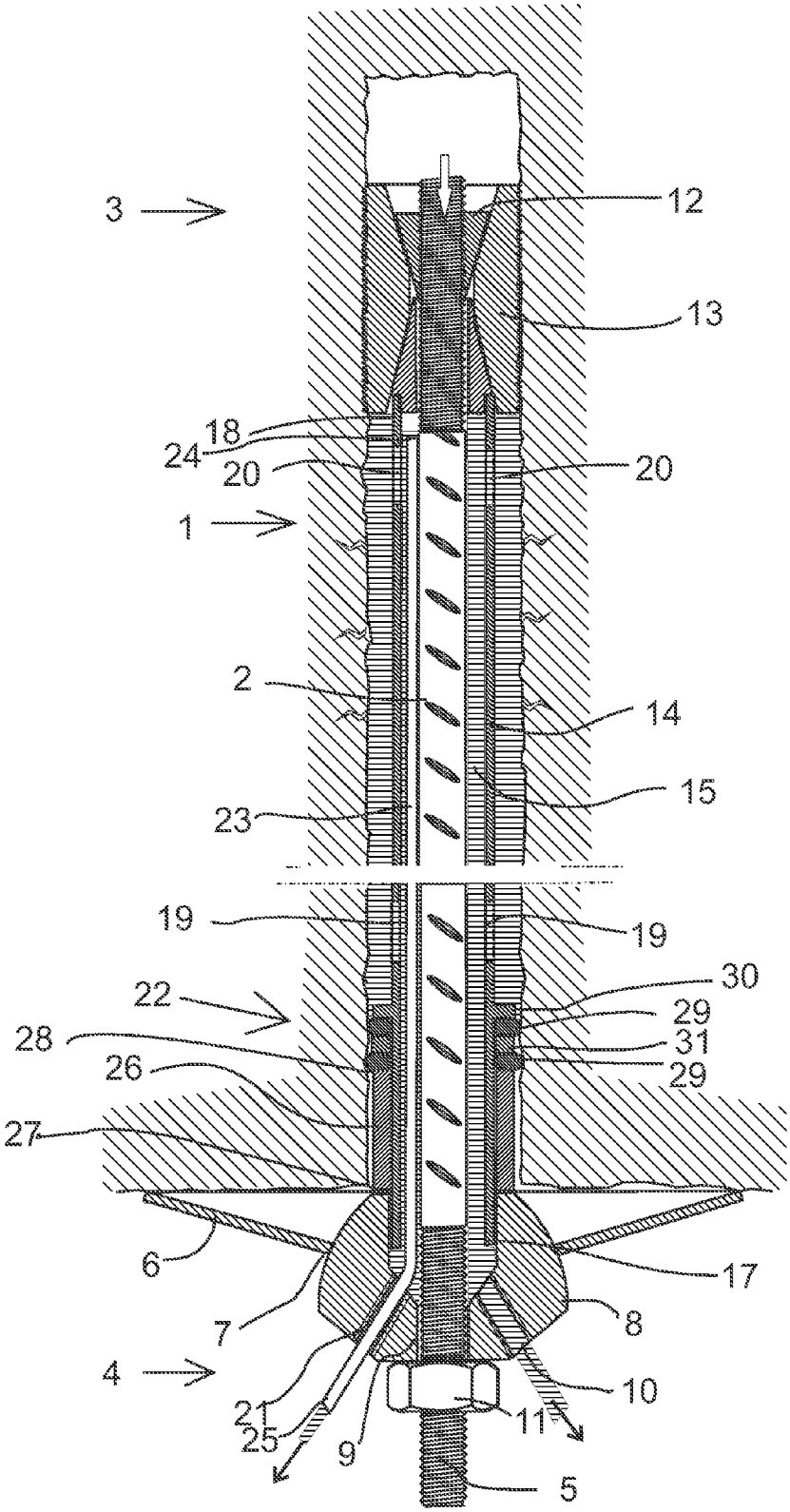
Figure 3:
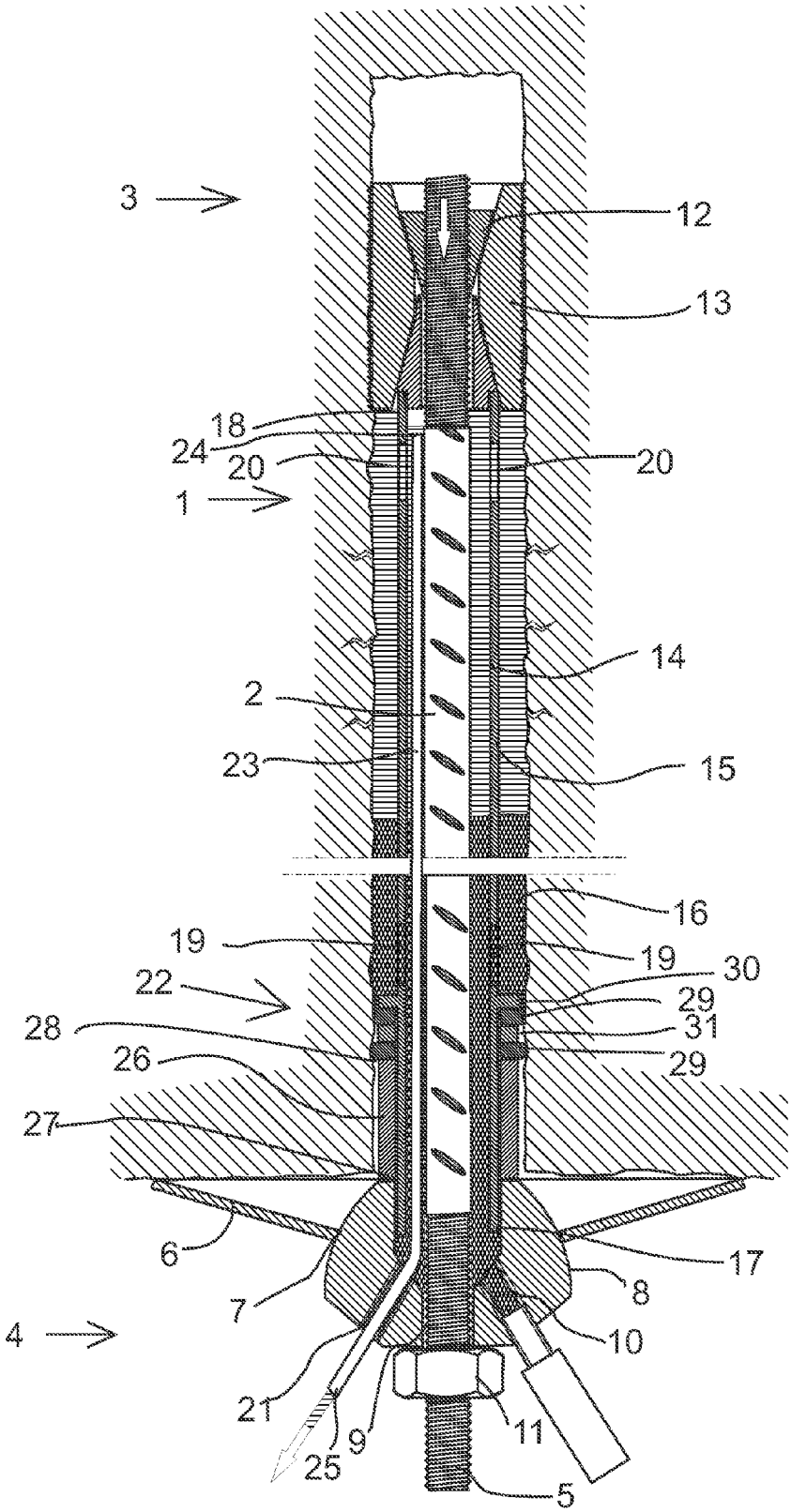
Figure 4:
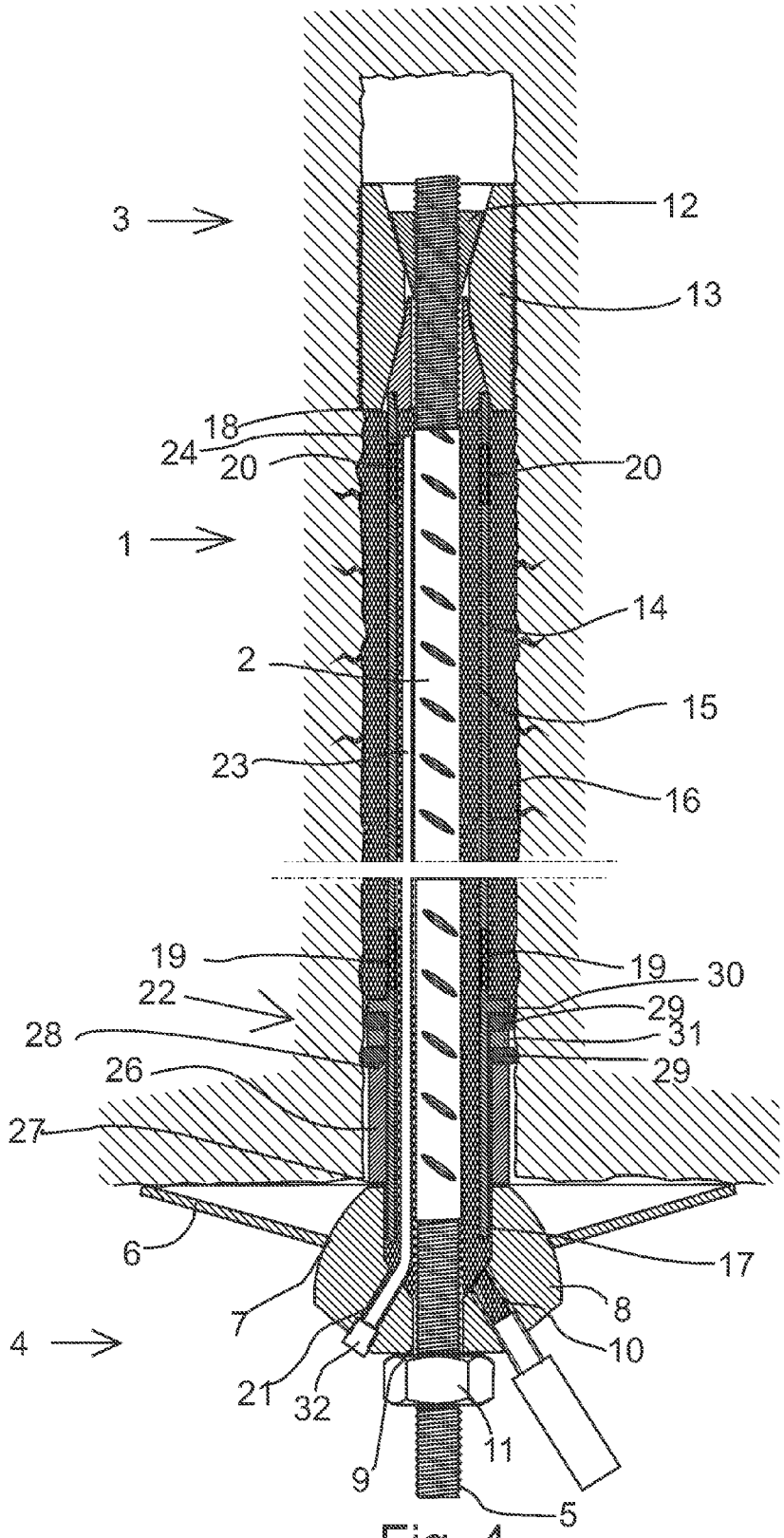

In the following section, the invention will be described in detail by way of embodiment examples with reference to the accompanying drawing, in which FIG. 1 shows a cross section of one embodiment of the rock anchor bolt according to the invention being inserted into a borehole, FIG. 2 shows the rock anchor bolt of FIG. 1 tightened in its place in a leaking borehole FIG. 3 shows the rock anchor bolt of FIG. 2 while grouting paste is being injected, and FIG. 4 shows FIG. 3 after injection of the grouting paste.

DETAILED DESCRIPTION OF THE INVENTION

FIG. 1 illustrates a rock anchor bolt 1 inserted into a borehole bored in a rock to be tightened in its place.

With reference to FIGS. 1-4, the rock anchor bolt 1 includes a drawbar 2 with an inner end 3 to be inserted into the borehole and an outer end 4 extending out from the borehole. The outer end of the drawbar 2 has an external thread 5. The drawbar 2 is preferably a reinforcing steel bar.

Further, the rock anchor bolt 1 includes a support plate 6 for supporting the outer end of the rock anchor bolt against the surface of the rock around the mouth of the borehole. The support plate has a center hole 7.

A centering member 8 is provided at the outer end 4 of the drawbar 2 in the center hole 7 of the support plate. The centering member 8 includes a central hole 9 through which the outer end 4 of the drawbar 2 is adapted to extend. In addition, the centering member has an injection hole 10 through which grouting paste 16 (see FIGS. 3 and 4) can be injected.

In order to tightly lock the rock anchor bolt 1 in its place, the rock anchor bolt 1 includes a conical wedge anchoring mechanism at the inner end 3 of the drawbar. The structure of the anchoring mechanism provided with two conical wedges according to FIGS. 1-4 is more specifically described in patent application 20115182 and a mechanism provided with a single conical wedge is described in more detail in utility model FI-U9687.

A tightening nut 11 is turned on the external thread 5 of the outer end of the drawbar against the centering member 8 in order to draw the drawbar 2 outward relative to the borehole for tightening the anchor bolt in its place. A conical member 12 is substantially immovably connected to the drawbar 2 in the vicinity of the inner end 3 of the drawbar. The conical member 12 is provided inside the expansion member 13. The expansion member 13 expands as the drawbar 2 is being drawn outward by turning the tightening nut 11 and the conical member 12 is being forced at the same time inside the expansion member 13 for expanding the expansion member and making it adhere to the wall of the borehole.

A tube 14 is fitted around the drawbar 2. The tube 14 is made of a rigid material, such as plastic or steel. A casting space 15 is provided between the tube 14 and the drawbar 2 so as to receive and carry grouting paste 16 injected through the injection hole 10 of the centering member 8. The outer end 17 of the tube 14 is supported on the centering member 8. The tube 14 has casting holes 19, 20 allowing the injected grouting paste 16 to flow between the casting space 15 and the space between the tube 14 and the wall of the borehole.

The centering member 8 includes an outlet hole 21 for removing any leakage water flowing into the borehole. A sealing device 22 is provided around the outer end 17 of the tube 14 for sealing the borehole watertight as the tightening nut 11 is being tightened. An outlet tube 23 is provided in the casting space 15 between the tube 14 and the drawbar 2 for carrying out any leakage water as grouting paste 16 is being injected. The inner end 24 of the outlet tube 23 extends to the vicinity of the expansion member 13 and the outer end 25 of the outlet tube 23 extends out through the outlet hole 21 of the centering member 8. The tube 14 has one or more first casting holes 19 at the outer end 17 of the tube 14 in the vicinity of the sealing device 22. In addition, the tube 14 has one or more second casting holes 20 at the inner end 18 of the tube in the vicinity of the expansion member 13.

The sealing device 22 includes a pressure sleeve 26 which is provided with play around the tube 14 so as to make the pressure sleeve 26 axially movable in the direction of the tube. The first end 27 of the pressure sleeve 26 is disposed against the centering member 8. A seal ring 29 is made of a flexible material formable under pressure, such as rubber. The seal ring is provided against the pressure sleeve 26. An abutment member 30 is fixed relative to the tube 14 and located on the opposite side of the seal ring 29 relative to the pressure sleeve 26.

The sealing device 22 of FIGS. 1-4 includes two seal rings 29 provided between the pressure sleeve 26 and the abutment member 30. An intermediate sleeve 31 is disposed between these two adjacent seal rings 29 with play around the tube 14.

With reference to FIGS. 1-4, the functioning of the rock anchor bolt 1 is explained during installation in a borehole, the cracks of the wall of which are leaking with water. In the figures, the leakage water is illustrated by horizontal lines.

The rock anchor bolt 1 is inserted in the borehole. The tightening nut 11 is turned, making the drawbar 2 move outward and draw the conical member 12 inside the expansion member 13 so as to expand the expansion member 13 and press its outer surface tightly against the wall of the borehole, anchoring the bolt in its place. At the same time as the tightening nut 11 is being turned, the sealing device 22 seals the borehole. As the tightening nut 11 is being turned, it moves the centering member 8 moving in turn the pressure sleeve 26 to press the lower seal ring 29 which, via the intermediate sleeve 31, presses in turn the upper seal ring 29 against the abutment member 30, the seal rings expanding under pressure and becoming sealed against the wall of the borehole, providing watertightness.

In FIG. 2, the seal device 22 is tightened in its sealing position. FIG. 2 illustrates a situation where leakage water has filled the space between the tube 14 and the wall of the borehole as well as the casting space 15.

In FIG. 3, injection of grouting paste 16 has been started using an injection device installed in the injection hole 10 of the centering member 8 and introducing the grouting paste via the interior space of the centering member into the casting space between the tube 14 and the drawbar 2. From inside the tube 14, the grouting paste flows through the first casting holes 19 in the tube 14 right above the sealing device 22 into the space between the tube 14 and the wall of the borehole outside of the tube 14. The grouting paste 16 is spread from below upwards, filling at the same time the space between the tube 14 and the drawbar 2 as well as the tube 14 and the wall of the borehole and removes ahead of it any water or air into the mouth of the inner end 24 of the outlet tube 23 and the water and air are removed out along the outlet tube 23.

Filling up of the rock anchor bolt and the borehole with the grouting paste is detected as the grouting paste starts to flow out from the outlet tube 23, in which case the rock anchor bolt and the borehole are filled with the grouting paste. After injection, the part of the outlet tube 23 extending from the outlet hole is removed and a screw plug 32 is turned into the threaded outlet hole 21 for closing the hole. After this, grouting paste is still continued to be injected so that any small cracks of the wall of the borehole can also be filled. After injection, the injection hole 10 is closed.

The invention is not limited merely to the embodiment examples referred to above; instead, many variations are possible within the scope of the inventive idea defined by the claims.

The invention claimed is:

1. A rock anchor bolt, including a drawbar with an inner end to be inserted into a borehole and an outer end extending out from the borehole and having an external thread, a support plate for supporting the outer end of the rock anchor bolt against the surface of the rock around the mouth of the borehole, the support plate having a center hole, a centering member provided at the outer end of the drawbar in the center hole of the support plate, the centering member including a central hole through which the outer end of the drawbar is adapted to extend and an injection hole through which grouting paste can be injected, a tightening nut turned on the external thread of the outer end of the drawbar against the centering member in order to draw the drawbar outward relative to the borehole for tightening the anchor bolt in its place, a conical member connected substantially immovably to the drawbar in the vicinity of the inner end of the drawbar, an expansion member inside which the conical member is provided, the expansion member being adapted to expand as the drawbar is being drawn outward by means of the tightening nut and the conical member is moving at the same time relative to the expansion member for expanding the expansion member and making it adhere to the wall of the borehole, a tube made of a rigid material and fitted around the drawbar so that a casting space is provided between the tube and the drawbar for receiving and carrying grouting paste injected through the injection hole of the centering member, the tube including an outer end supported on the centering member, an inner end and casting holes in order to allow the injected grouting paste to flow between the space between the tube and the wall of the borehole and the casting space, wherein the centering member includes an outlet hole for removing any leakage water flowing into the bore-hole; that the rock anchor bolt includes a sealing device which is provided around the outer end of the tube to seal the borehole watertight as the tightening nut is being tightened, and an outlet tube which is provided in the casting space between the tube and the drawbar to carry out the leakage water as the grouting paste is being injected, the inner end of which outlet tube extends to the vicinity of the expansion member, the outer end of the outlet tube extending out through the outlet hole of the centering member; and that the tube has one or more first casting holes at the outer end of the tube in the vicinity of the sealing device and one or more second casting holes at the inner end of the tube in the vicinity of the expansion member, whereby, as grouting paste is being injected, it fills the casting space between the tube and the drawbar as well as the space between the borehole and the tube from the outer end toward the inner end so that any leakage water is forced ahead of the grouting paste to the inner end of the outlet tube.

2. The anchor bolt according to claim 1, wherein the sealing device includes a pressure sleeve provided with play around the tube so that it moves axially in the direction of the tube, the pressure sleeve having a first end against the centering member and a second end, a seal ring made of a flexible material formable under pressure, such as rubber, provided against the pressure sleeve, an abutment member which is fixed relative to the tube and located on the opposite side of the seal ring relative to the pressure sleeve, whereby, as the tightening nut is being turned, the pressure sleeve presses the seal ring against the abutment member, the seal ring expanding under pressure and becoming sealed against the wall of the borehole.

3. The anchor bolt according to claim 2, wherein the sealing device includes two or more seal rings provided between the pressure sleeve and the abutment member with an intermediate sleeve between each two adjacent seal rings with play around the tube.

4. The anchor bolt according to claim 1, wherein the sealing device includes two or more seal rings provided between a pressure sleeve and an abutment member with an intermediate sleeve between each two adjacent seal rings with play around the tube.

* * * * *